US006520081B2

(12) United States Patent
Oh

(10) Patent No.: US 6,520,081 B2
(45) Date of Patent: Feb. 18, 2003

(54) BALL BRAYER

(75) Inventor: Wan-Young Oh, Seoul (KR)

(73) Assignee: DN Craft Corporation, Songpa-gu (KR)

( * ) Notice: Subject to any disclaimer, the term of this patent is extended or adjusted under 35 U.S.C. 154(b) by 0 days.

(21) Appl. No.: 09/954,011

(22) Filed: Sep. 18, 2001

(65) Prior Publication Data

US 2002/0092433 A1 Jul. 18, 2002

(30) Foreign Application Priority Data

Jan. 17, 2001 (KR) ..... 01-1257

(51) Int. Cl.[7] ..... B41F 9/00

(52) U.S. Cl. ..... 101/329; 101/328; 101/333; 101/405; 401/48; 401/209

(58) Field of Search ..... 101/333, 329, 101/328, 405, 330, 331, 406; 401/146, 48, 150, 196, 208, 209

(56) References Cited

U.S. PATENT DOCUMENTS 5,495,800 A * 3/1996 Weissbein et al. ..... 101/329

6,378,426 B1 * 4/2002 Furr et al. ..... 101/328

* cited by examiner

*Primary Examiner*—Andrew H. Hirshfeld
*Assistant Examiner*—Kevin D. Williams
(74) *Attorney, Agent, or Firm*—Browdy and Neimark, P.L.L.C.

(57) ABSTRACT

A ball brayer, provided with a brayer ball fabricated with a patterned ball cover and smoothly rolling on a sheet in any desired direction during a stamping process, is disclosed. This ball brayer includes a roller holder unit consisting of a front head and a handle. A dome-shaped first upper cap unit is seated in the front head of the roller holder unit. A dome-shaped second upper cap unit, having a cylindrical top rod, is seated in the first upper cap unit by the top rod inserted into the inner fitting cylinder of the first upper cap unit. The brayer ball, consisting of a spherical core body and a ball cover formed on the spherical core body, is rotatably seated in the second upper cap unit. A lower support cap unit is detachably mounted to the second upper cap unit. This lower support cap has an opening capable of allowing the brayer ball to be partially exposed outside the second upper cap unit.

8 Claims, 12 Drawing Sheets

BALL BRAYER

BACKGROUND OF THE INVENTION

1. Field of the Invention

The present invention relates to brayers, or hand-operated ink-stamping devices of small size typically used for making proofs and, more particularly, to a brayer provided with a brayer ball, fabricated with a patterned ball cover formed on a spherical core body and having an external pattern consisting of a variety of letters, figures and/or characters, thus smoothly rolling on a sheet in any desired direction without being limited in its rolling direction during a stamping process.

2. Description of the Prior Art

FIGS. 1*a* and 1*b* are views of a conventional brayer. As shown in the drawings, the conventional brayer 100 comprises a roller holder 200 and a cylindrical brayer roller 400. The roller holder 200 has a handle 110 at its rear portion and two brackets 220 at its front head portion. The two brackets 220 integrally extend downward from opposite sides of the front head portion of the roller holder 200, with a yoke bearing 210 formed at the lower end of each bracket 220 to hold each end of a roller shaft 300. The brayer roller 400 is a cylindrical member having a predetermined length, and is fitted over the roller shaft 300 so as to be rotatable around the roller shaft 300. The brayer roller 400 is made of rubber, and is embossed on its circumferential surface to form a desired pattern, consisting of a variety of letters, figures and/or characters.

In order to stamp a desired pattern onto a sheet using the brayer 100, a user rolls the brayer roller 400 on an inkpad to allow the patterned surface of the roller 400 to be smeared with ink. Thereafter, the brayer roller 400 is rolled on a target sheet, such as a paper sheet, to stamp the pattern of the roller 400 consisting of letters, figures and/or characters onto the sheet.

During a stamping process using such a conventional brayer 100, the desired pattern of the brayer roller 400 is effectively stamped onto a sheet only when the user rolls the brayer roller 400 on the sheet by pulling or pushing the brayer 100 linearly by the hand, gripping the handle 110, to form a linear print. When the brayer roller 400 is rolled on a sheet to form a circular print as shown in FIG. 1*b,* the inside portion of the longitudinal cylindrical roller 400 around the center of the circular print is rolled at a low speed with a small radius "H1".

On the contrary, the outside portion of the longitudinal cylindrical roller 400 around the outer edge of the circular print is rolled at a high speed with a large radius "H2". Due to such a difference in the radius and rolling speed between the two portions of the brayer roller 400 while rolling the brayer 100 through a circular or curved trace, the letters, figures and/or characters of the pattern stamped onto the sheet are undesirably distorted and deformed. In addition, the stamped effect in such a case is not uniform since the stamped pattern is undesirably, partially faint or broken at a portion stamped by the outside portion of the roller 400. Furthermore, the inside portion of the stamped pattern is smeared with an excessive amount of ink, and so it is clearly and thickly stamped, but is not easily or quickly dried, thus being likely to undesirably run over the sheet.

SUMMARY OF THE INVENTION

Accordingly, the present invention has been made keeping in mind the above problems occurring in the prior art, and an object of the present invention is to provide a ball brayer, which is provided with a brayer ball fabricated with a patterned ball cover, having an external pattern consisting of letters, figures and/or characters and formed on a spherical core body, the brayer ball thus smoothly rolling on a sheet in any desired direction without being limited in its rolling direction during a stamping process, and preventing a stamped pattern from being distorted, deformed, or undesirably, partially faint or broken.

In order to accomplish the above object, the present invention provides a ball brayer, comprising a roller holder unit having a front head and a handle; a dome-shaped first upper cap unit seated in the front head of the roller holder unit; a dome-shaped second upper cap unit provided with a cylindrical top rod, the second upper cap unit being seated in the first upper cap unit by the top rod inserted into an inner fitting cylinder of the first upper cap unit; a brayer ball rotatably seated in the second upper cap unit and consisting of a spherical core body, and a ball cover formed on the spherical core body and having a pattern on its external surface; and a lower support cap unit detachably mounted to the second upper cap unit, and having an opening for allowing the brayer ball to be partially exposed outside the second upper cap unit.

BRIEF DESCRIPTION OF THE DRAWINGS

The above and other objects, features and other advantages of the present invention will be more clearly understood from the following detailed description taken in conjunction with the accompanying drawings, in which:

FIGS. 1*a* and 1*b* are views of a conventional brayer, in which:

FIG. 1*a* is a front view of the brayer; and

FIG. 1*b* is a left side view of the brayer;

FIGS. 4*a* and 4*b* are sectional views of the ball brayer according to the primary embodiment of the present invention, in which:

FIG. 4*a* is a front sectional view of the ball brayer;

FIG. 4*b* is a side sectional view of the ball brayer;

DETAILED DESCRIPTION OF THE INVENTION

Figure 1A:
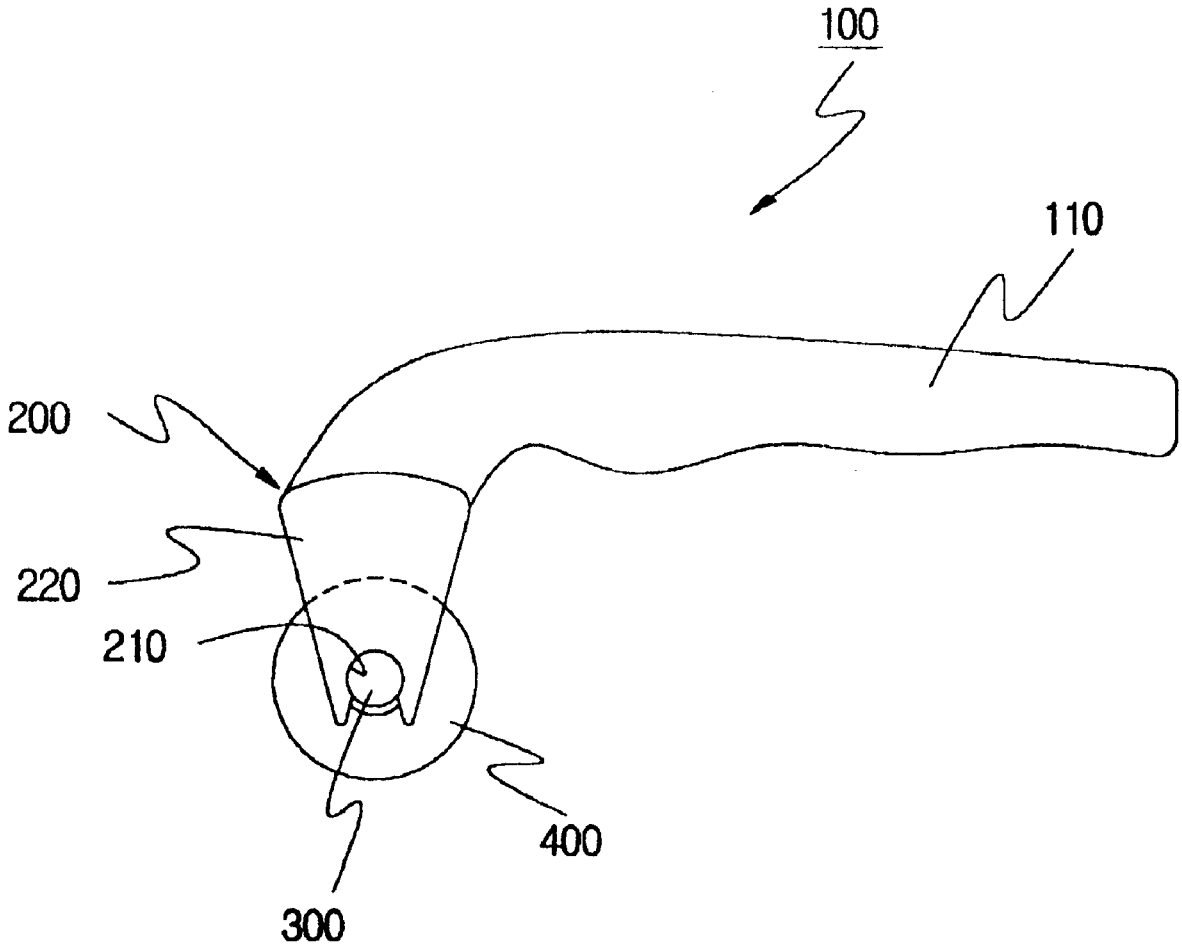
Figure 1B:
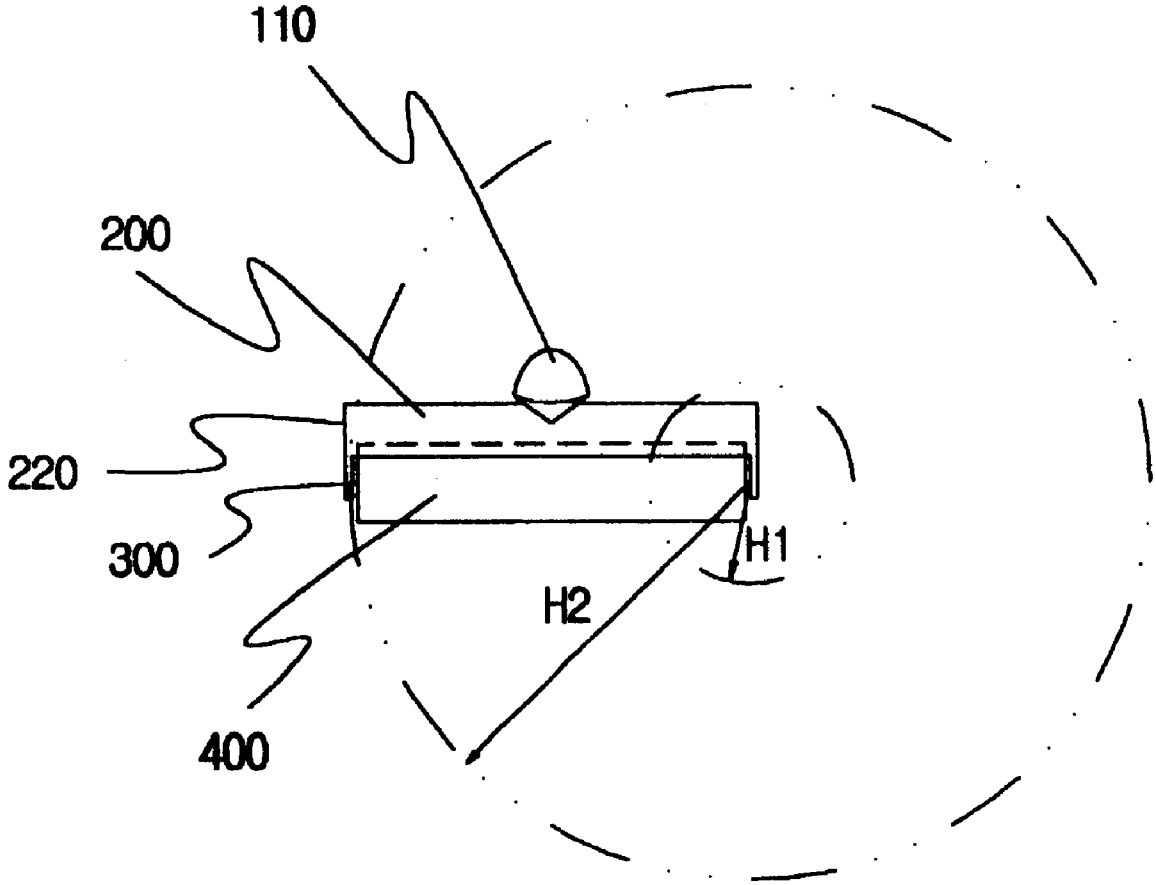

Reference now should be made to the drawings, in which the same reference numerals are used throughout the different drawings to designate the same or similar components.

Figure 2:
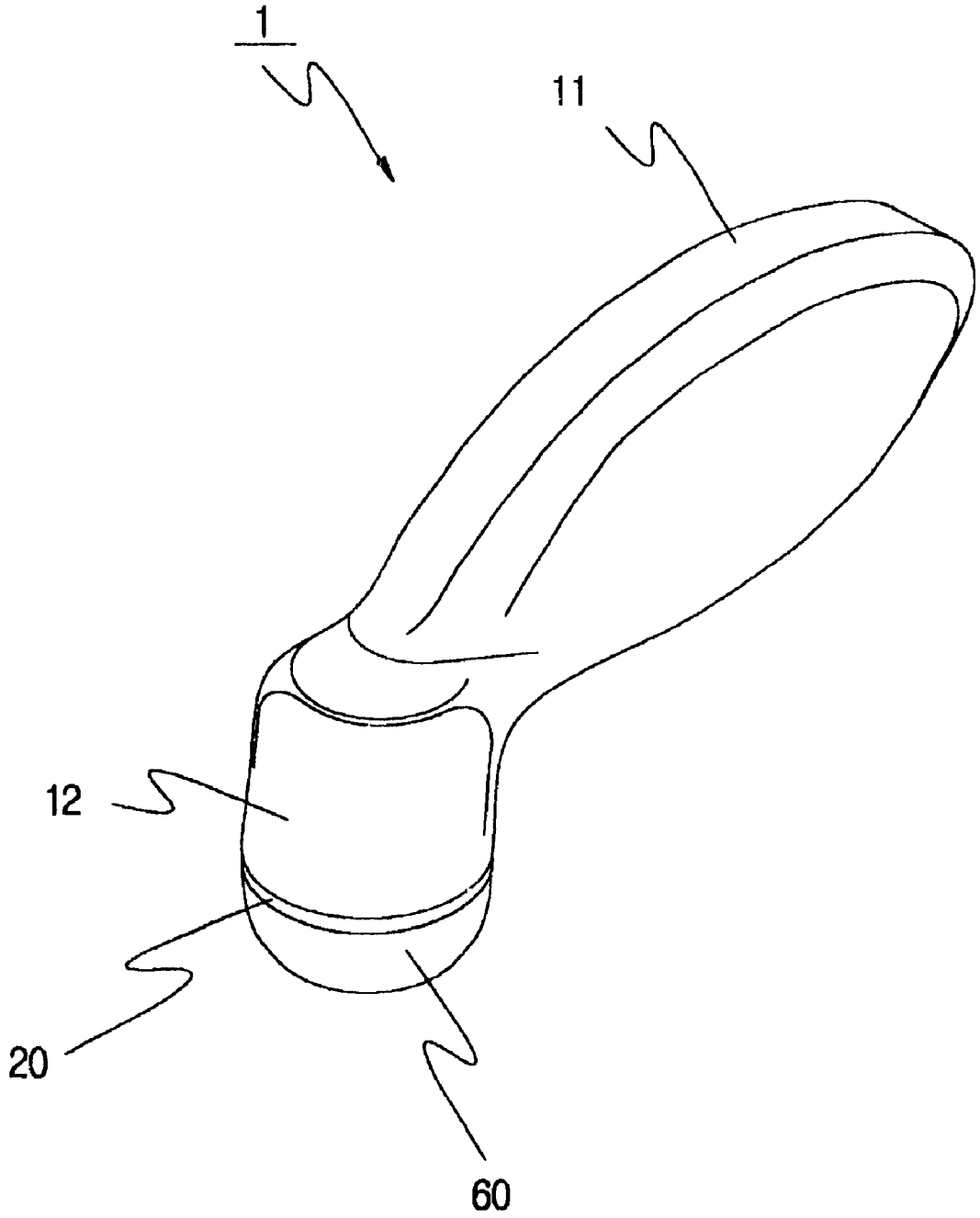
FIG. 2 is a perspective view, showing the appearance of a ball brayer in accordance with the primary embodiment of the present invention.
Figure 3:
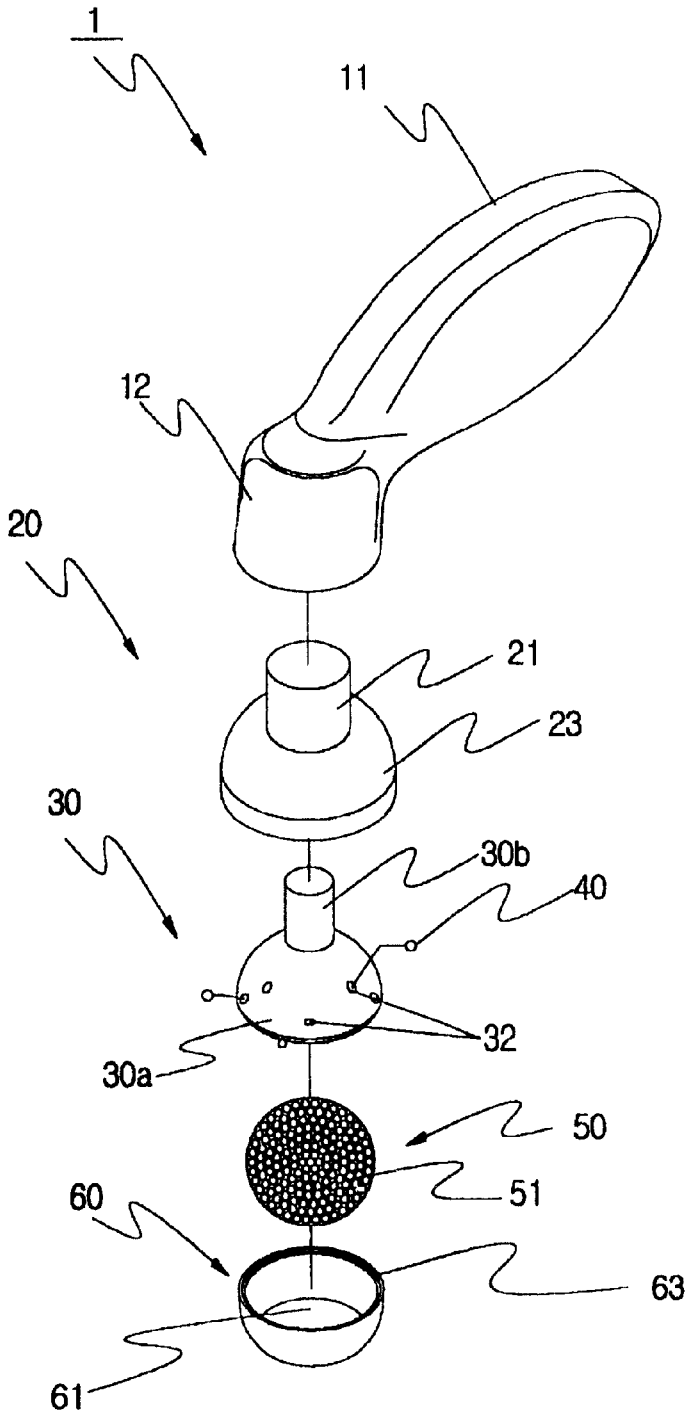
FIG. 3 is an exploded perspective view of the ball brayer according to the primary embodiment of the present invention.

FIG. 2 is a perspective view, showing the appearance of a ball brayer in accordance with the primary embodiment of the present invention. FIG. 3 is an exploded perspective view of the above ball brayer. As shown in the drawings, the ball brayer 1 includes a roller holder unit 10 having a front head 12 at its front portion and a handle 11 at its rear portion. The ball brayer 1 also has a first upper cap unit 20, a second upper cap unit 30, a plurality of ball bearings 40, a brayer ball 50 and a lower support cap unit 60.

Figure 4A:
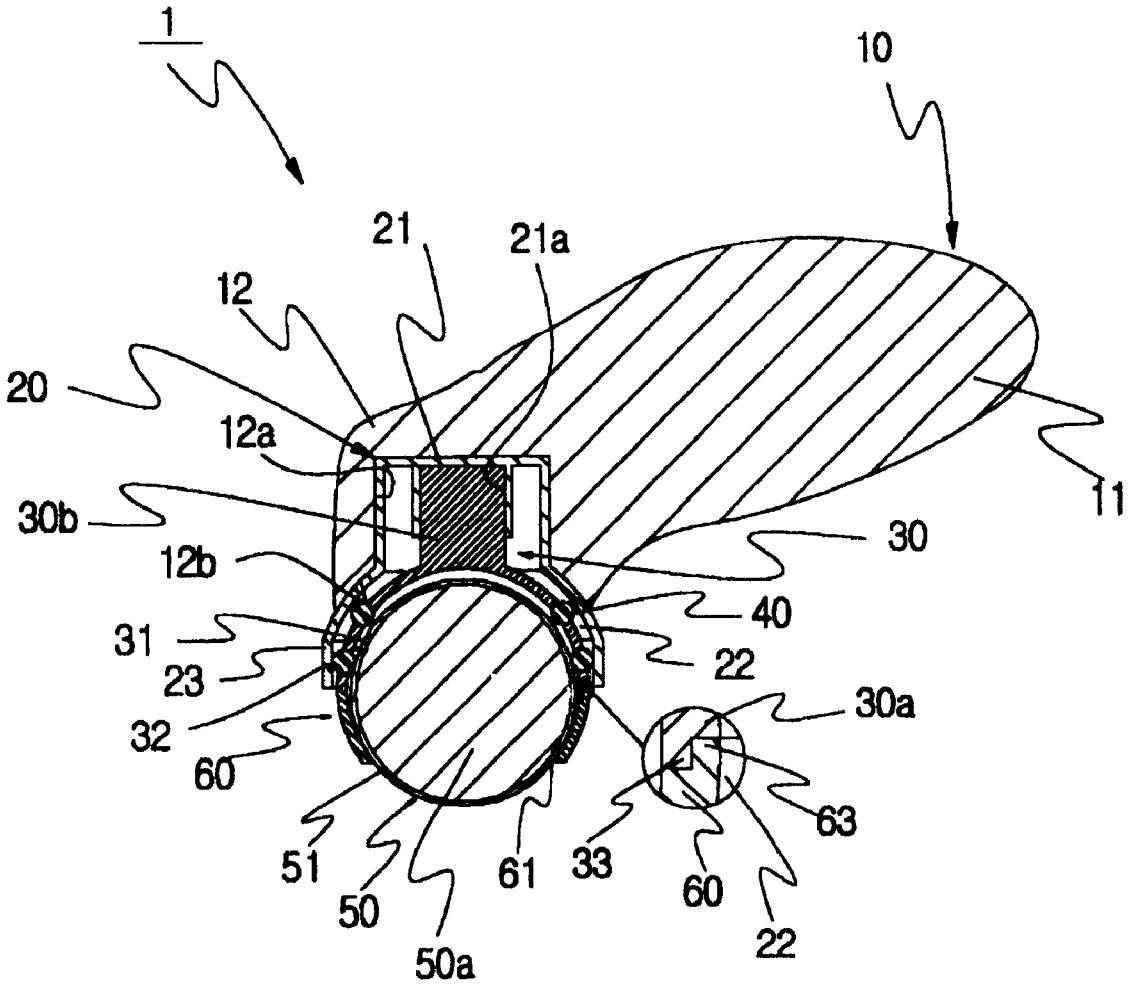
Figure 4B:
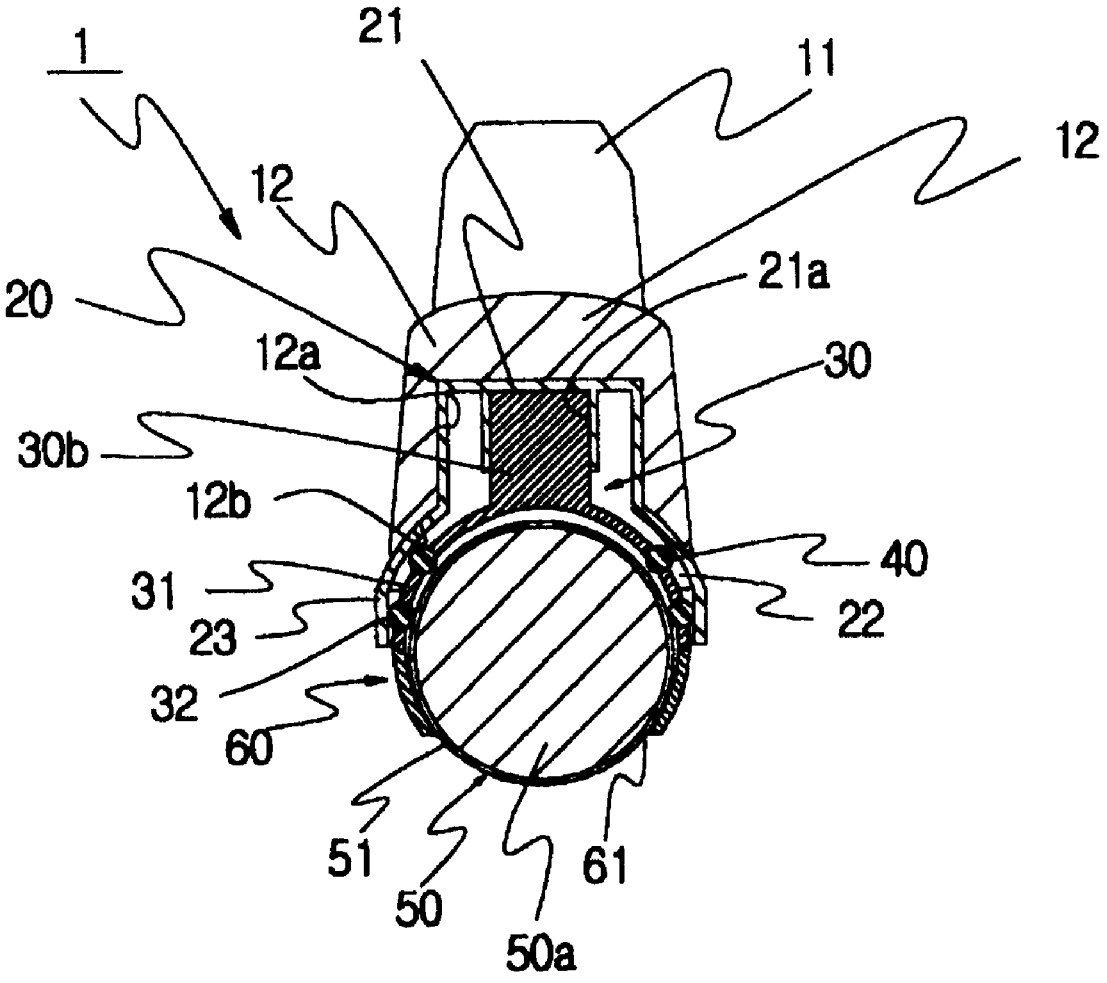

As shown in FIGS. 3, 4*a* and 4*b*, the front head 12 of the roller holder unit 10 is integrated with the handle 11. A holding depression 12*a* is vertically formed on the lower surface of the front head 12, with a seat opening 12*b* formed at the mouth of the depression 12*a* to communicate with the depression 12*a* and having a curved inner surface of a predetermined radius of curvature. The seat opening 12*b* is coaxial with the depression 12*a*.

The first upper cap unit 20 is a dome-shaped member, which has a hollow cylindrical top cap 21 at its top end. This top cap 21 is closed at its top end, and is inserted into the depression 12*a* of the holder unit 10, with an inner fitting cylinder 21*a* formed in the interior of the cap 21. A first hollow dome body 23 integrally extends downward from the lower edge of the top cap 21 to form the dome shape of the first upper cap unit 20. This first dome body 23 defines a first seat space 22 in its interior, and is opened at its lower end.

The second upper cap unit 30 is a dome-shaped member, which has a cylindrical top rod 30*b* at its top end. This top rod 30*b* is inserted into the inner fitting cylinder 21*a* of the first upper cap unit 20. A second hollow dome body 30*a* integrally extends downward from the lower edge of the top rod 30*b* to form the dome shape of the second upper cap unit 30. The interior of this second dome body 30*a* defines a second seat space 31 used for seating the ball 50 therein. A plurality of bearing holes 32 are formed on the sidewall of the second dome body 30*a* such that the bearing holes 32 communicate with the second seat space 31. A step 33 is formed along the lower edge of the second dome body 30*a*.

Figure 5:
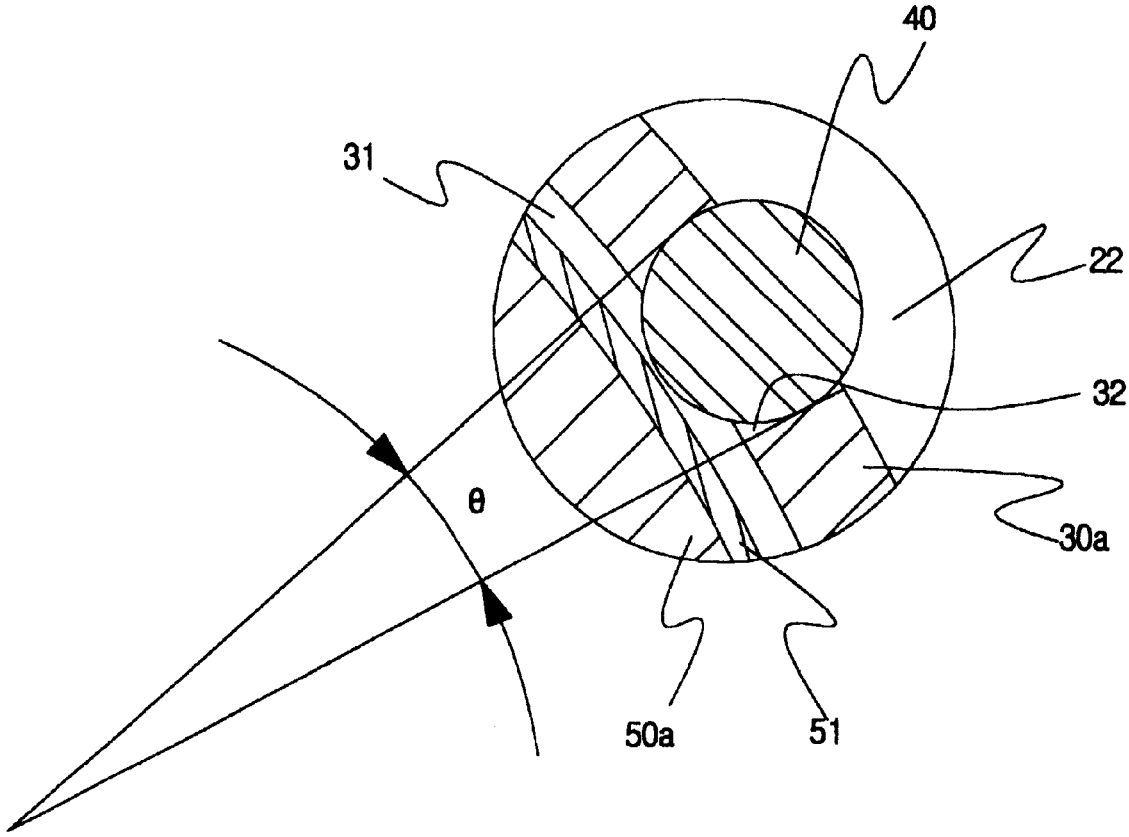
FIG. 5 is an enlarged sectional view of the portion "A" of the ball brayer of FIG. 4*a;*

The sidewall of each of the bearing holes 32 is tapered such that it forms a central angle θ relative to the center of the dome body 30*a* as shown in FIG. 5. That is, the diameter of each bearing hole 32 is linearly reduced from the external surface to the internal surface of the sidewall of the dome body 30*a*.

The ball bearings 40 are respectively set in the bearing holes 32 of the second upper cap unit 30 such that the bearings 40 partially project to both the first seat space 22 of the first upper cap unit 20 and the second seat space 31 of the second upper cap unit 30. The ball bearings 40 are preferably made of a metal or plastic material.

Figure 6:
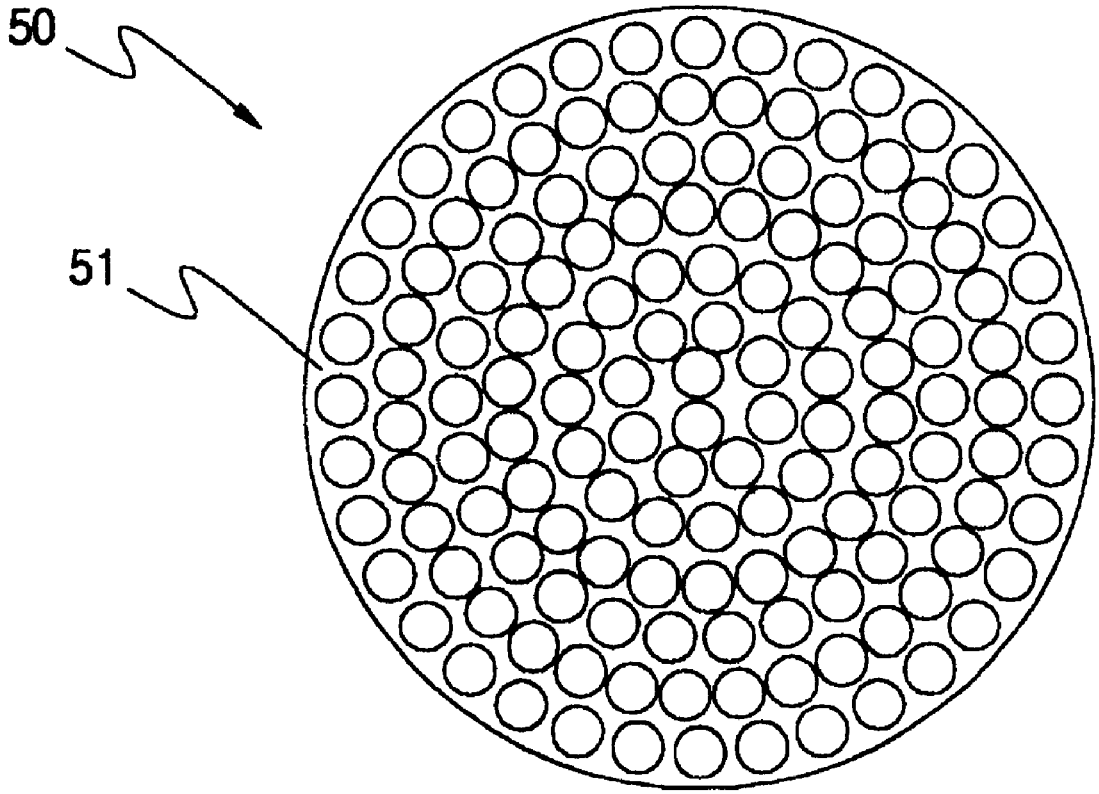
FIG. 6 is a front view, showing the appearance of a brayer ball included in the ball brayer according to the primary embodiment of the present invention.

The brayer ball 50 is seated in the second seat space 31 of the second upper cap unit 30 such that at least half of the ball 50 is positioned inside the space 31. As shown in FIGS. 4*a*, 4*b* and 6, the brayer ball 50 comprises a spherical core body 50*a*, and a ball cover 51 formed on the spherical core body 50*a* and preferably made of rubber or a soft plastic material.

As shown in FIG. 6, the ball cover 51 according to the primary embodiment has a simple external pattern. However, it should be understood that the external pattern 30 may consist of a variety of letters, figures and/or characters as desired.

In the present invention, each of the core body 50*a* and the ball cover 51 may be fabricated as a single structure. However, each of the core body 50*a* and the ball cover 51 may be fabricated as a separable structure without affecting the functioning of this invention.

Figure 7A:
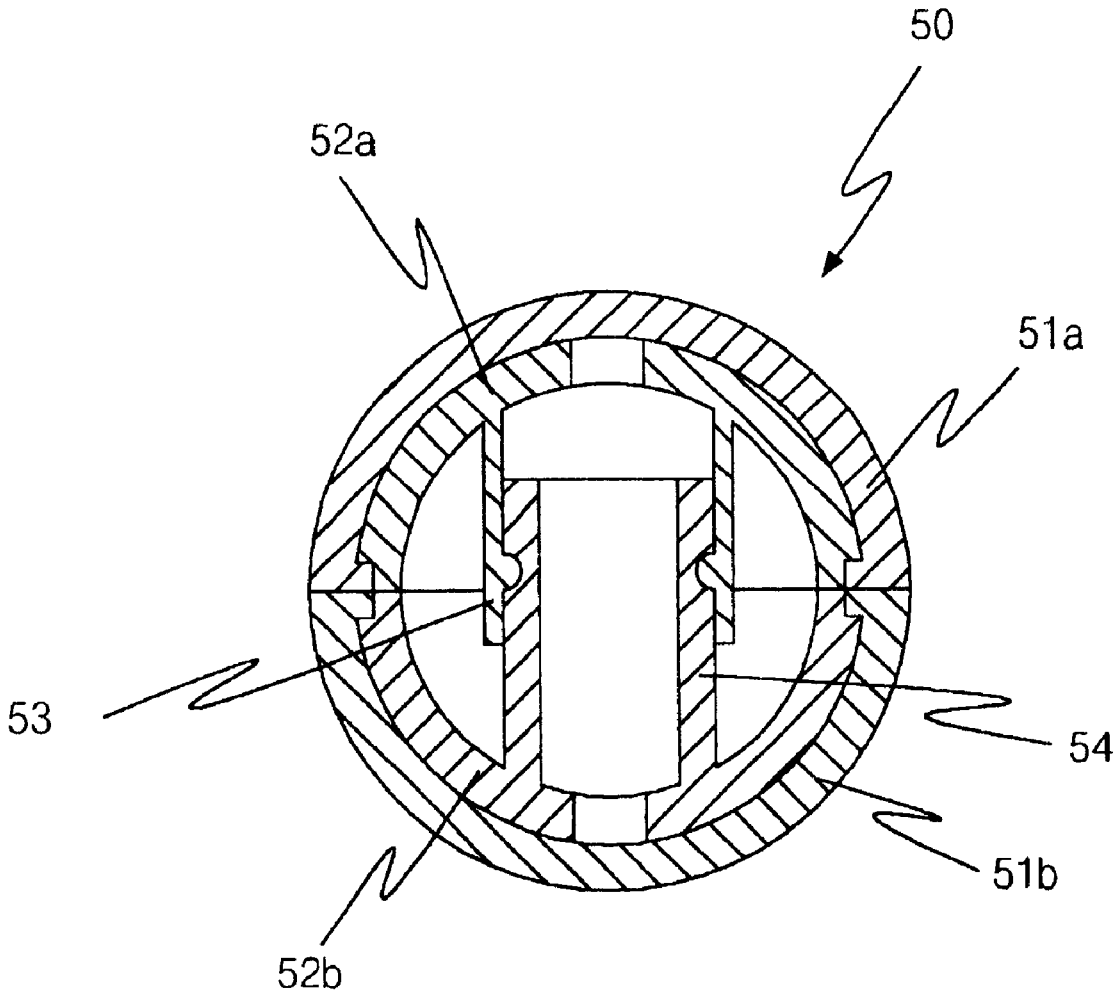
FIGS. 7*a* and 7*b* are sectional views of the brayer balls according to different embodiments of this invention.
Figure 7B:
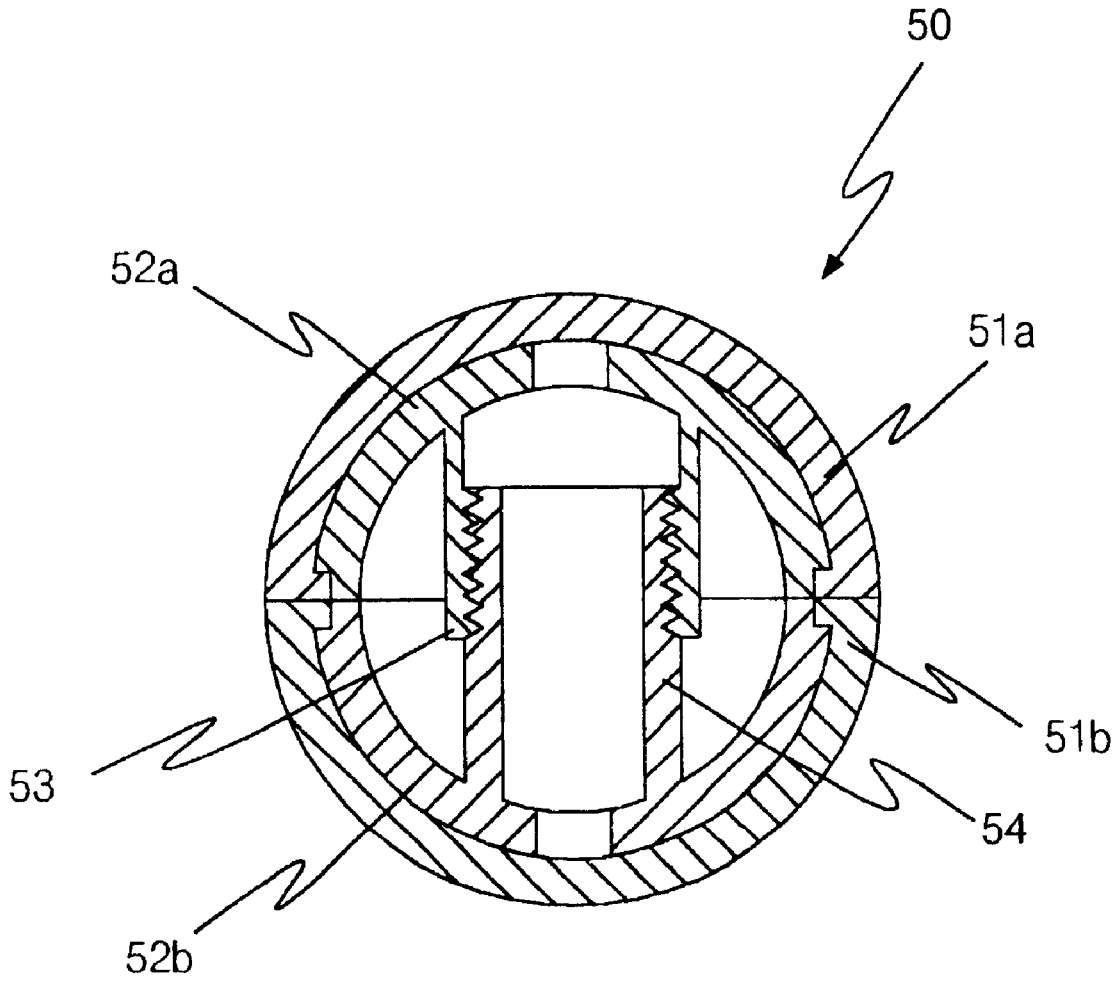

FIGS. 7*a* and 7*b* are sectional views of two brayer balls 50 in accordance with different embodiments of the present invention. As shown in the drawings, each of the spherical core body and the ball cover may be fabricated with a separable body consisting of two or more parts.

In each of the embodiments of FIGS. 7*a* and 7*b*, the separable core body of the brayer ball 50 consists of two hemispherical parts 52*a* and 52*b*, which are made of a metal or plastic material and are assembled into a single spherical body by means of two locking members 53 and 54. In the embodiments, the separable ball cover consists of two hemispherical parts 51*a* and 51*b*, which are made of a soft plastic or rubber metal and have an external pattern consisting of a variety of letters, figures and/or characters, and are formed on the two hemispherical parts 52*a* and 52*b*.

That is, in the embodiment of FIG. 7*a*, the locking members 53 and 54 for assembling the two hemispherical parts 52*a* and 52*b* into a single spherical core body comprise a fitting groove formed on one part and a fitting projection formed on the other part. In this embodiment, the fitting projection engages with the fitting groove, thus assembling the two hemispherical parts 52*a* and 52*b* into a single spherical core body. In the embodiment of FIG. 7*b*, the locking members 53 and 54 comprise an externally-threaded member and an internally-threaded member, which engage with each other to assemble the two hemispherical parts 52*a* and 52*b* into a single spherical core body.

The lower support cap unit 60 is detachably mounted to the step 33 formed along the lower edge of the second dome body 30*a* of the second upper cap unit 30, thus preventing the ball 50 from being undesirably removed from the second upper cap unit 30. In order to engage with the step 33 of the second upper cap unit 30, the lower support cap unit 60 has a step 63 along its upper edge. This lower support cap unit 60 also has an opening 61 at its lower end so as to allow the ball 50 to be partially exposed outside the second upper cap unit 30.

Figure 8:
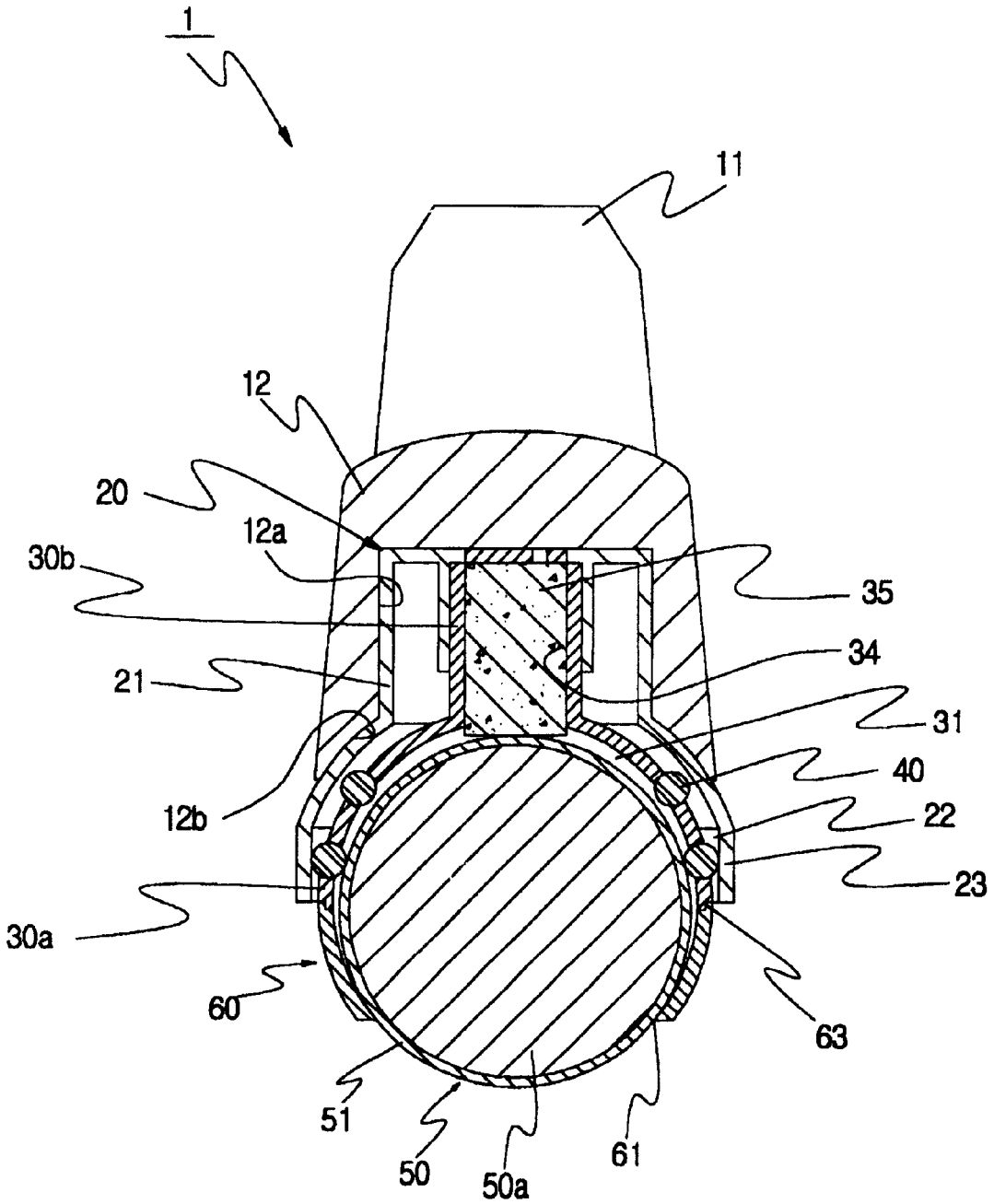
FIG. 8 is a sectional view of a ball brayer in accordance with the second embodiment of the present invention.

FIG. 8 is a sectional view of a ball brayer in accordance with the second embodiment of the present invention. In this embodiment, the cylindrical top rod 30*b* of the second upper cap unit 30 is provided with a seat hole 34. An ink absorber 35, laden with a sufficient amount of ink, is seated in the seat hole 34 such that the lower surface of the ink absorber 35 comes into contact with the external surface of the brayer ball 50. In this embodiment, an openable lid is preferably provided on the top wall of the top cap 21 of the first upper cap unit 20.

Figure 9:
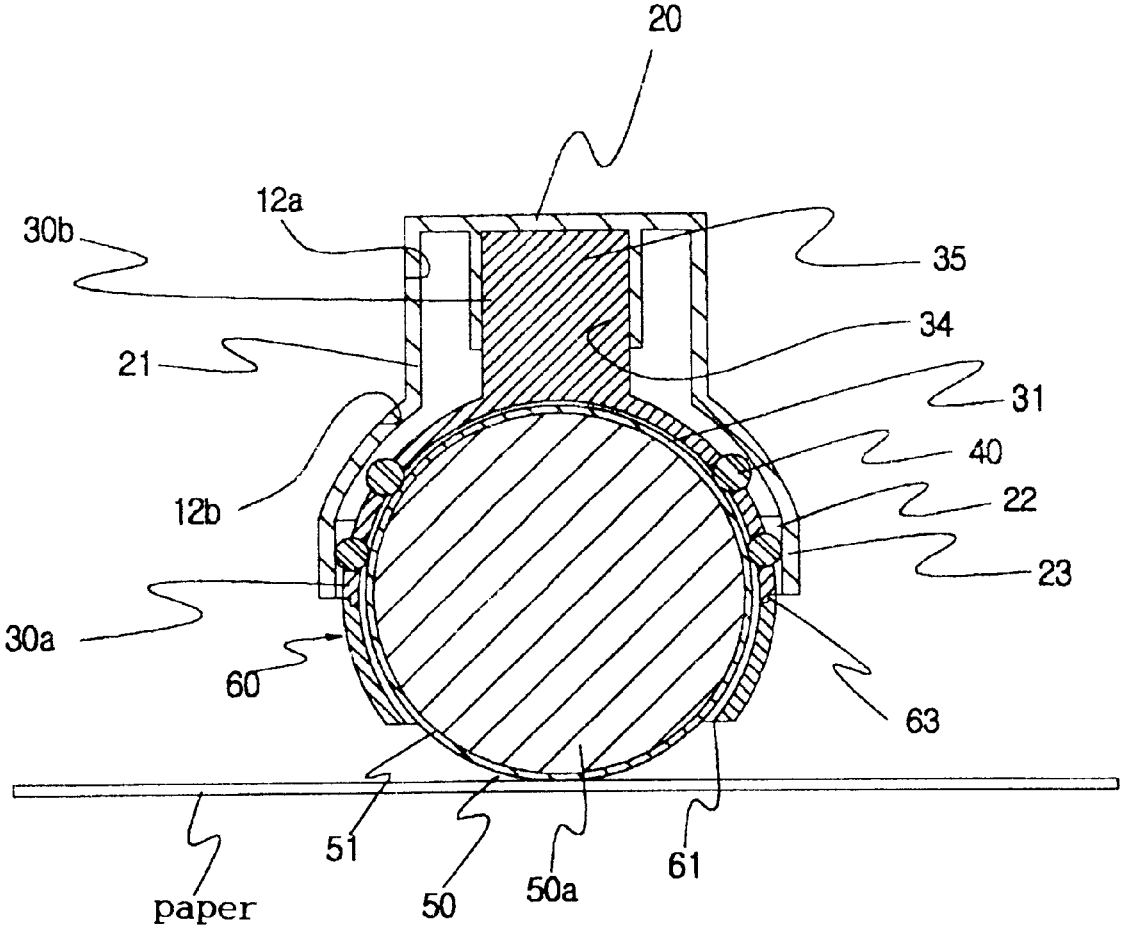
FIG. 9 is a sectional view, showing an operation of the ball brayer according to the primary embodiment of the present invention.

FIG. 9 is a sectional view, showing an operation of the ball brayer according to the primary embodiment of the present invention. As shown in the drawing, in order to stamp a desired pattern onto a sheet using the ball brayer 1, a user rolls the brayer ball 50, exposed outside the opening 61 of the lower support cap unit 60, on an inkpad to allow the patterned surface of the ball cover 51 to be smeared with ink.

When the spherical brayer ball 50 of this invention is rolled on an inkpad to allow the pattern of the ball cover 51 to be smeared with ink as described above, the brayer ball 50 is different from a conventional cylindrical brayer roller 400 in its ink smearing effect as follows. That is, when the conventional brayer roller 400 is linearly rolled on an inkpad to the front, back, left or right to be smeared with ink on its patterned surface, the patterned surface may be not smeared with ink on a part thereof in the case of a roller 400 having a large outer diameter. In addition, when the brayer roller 400 has a length exceeding the length of the inkpad, it is necessary to primarily roll the roller 400 on the inkpad to smear ink on one side of the longitudinal roller 400, and secondarily roll the remaining side of the roller on the inkpad to smear ink on that remaining side. However, in such a case, the primarily smeared ink on the patterned surface of the roller 400 is exposed to atmospheric air and undesirably dried when the roller 400 is secondarily rolled on the inkpad. It is thus impossible for the conventional cylindrical brayer roller 400 to accomplish a desired stamping effect.

However, since the brayer ball 50 of this embodiment is rotatable in every direction at an angle of 360°, the ball 50 is uniformly smeared with ink on its pattern, in addition to only requiring a small area of an inkpad when the ball 50 rolls on the inkpad.

After smearing ink on the external surface of the brayer ball 50, the ball 50 is rolled on a target sheet in every direction with appropriate pressure, thus stamping an inked pattern on the sheet by the external pattern of the ball cover 51 consisting of letters, figures and/or characters.

In the primary embodiment of this invention, the spherical core body 50*a* is fabricated with an integrated single structure. However, the spherical core body may be fabricated with a separable body consisting of two or more parts 52*a* and 52*b* as shown in FIGS. 7*a* and 7*b*. In such a case, the ball cover preferably consists of two or more separable parts 51*a* and 51*b* such that the cover may be replaced with another one. It is thus possible to easily change the pattern of the ball cover as desired.

In addition, the spherical brayer ball 50 of this invention is rotatable at an angle of 360°, and so the ball 50 is effectively rotatable in every direction when the ball 50 is rolled on an inkpad or on a target sheet. That is, the brayer ball 50 of this invention is effectively rotatable in every direction while being easily turned to left or right when the ball 50 is linearly rolled on an inkpad or on a target sheet to the front or back. Therefore, the brayer ball 50 is uniformly smeared with ink on its pattern during a rolling action on the inkpad and uniformly stamps a pattern on a target sheet during a rolling action on the sheet.

When the ball 50 comes into contact with the target sheet, the ball 50 is pressed upward into the second seat space 31 defined in the interior of the second dome body 30*a,* thus being brought into contact with the ball bearings 40 set in the bearing holes 32 of the second dome body 30*a* as shown in FIG. 5. Therefore, the ball 50 is seated in the space 31 while leaving a gap between the external surface of the ball 50 and the internal surface of the second dome body 30*a*.

The gap, defined between the external surface of the ball 50 and the internal surface of the second dome body 30*a,* prevents the ball 50 from coming into contact with the internal surface of the second dome body 30*a*. Due to the gap, it is possible to prevent an undesired spreading of ink on the internal surface of the second dome body 30*a*. The ball brayer 1 thus conserves ink, prevents a dripping of ink and stamps a desired clear inked pattern on a target sheet during a stamping process.

When the ball 50 is pressed upward into the second seat space 31, and comes into contact with the ball bearings 40 set in the bearing holes 32 as described above, it is possible to significantly reduce the contact surface area of the ball 50 within the seat space 31. This reduces frictional force generated between the ball 50 and the second dome body 30*a* during a rolling action of the ball 50, thus allowing a smooth rolling action of the ball 50 during a stamping process.

When the ball 50 is pressed upward and brought into contact with the ball bearings 40 set in the bearing holes 32, the bearings 40 are forced outward in a radial direction. In such a case, the bearings 40 come into contact with the internal surface of the dome body 23 of the first upper cap unit 20, thus being retained at their desired positions, at which the bearings 40 stably hold the ball 50 during a rolling action of the ball 50.

During such a rolling action, the brayer ball 50 is easily and smoothly rotated, and rolls along a short distance to be effectively smeared with ink on the external surface of the ball cover 51, and stamp a desired inked pattern onto a target sheet, such as a paper sheet.

In the embodiment of FIG. 8, the cylindrical top rod 30*b* of the second upper cap unit 30 has the seat hole 34. The ink absorber 35, laden with a sufficient amount of ink, is seated in the seat hole 34 such that the lower surface of the absorber 35 comes into contact with the external surface of the brayer ball 50.

The ball brayer 1 of this embodiment is advantageous in that it is usable without requiring a separate inkpad since it has the integral inkpad.

In a detailed description, the ink absorber 35 is seated in the seat hole 34 of the second upper cap unit 30 such that the lower surface of the absorber 35 is partially projected into the space 31 of the second upper cap unit 30 and comes into contact with the external surface of the brayer ball 50 seated in the space 31. Therefore, the external pattern of the ball cover 51 is smeared with a sufficient amount of ink by the ink absorber 35 during a rolling action of the ball 50 on a target sheet. Therefore, the ball brayer 1 of FIG. 8 is effectively usable without requiring a separate inkpad.

When the stamped pattern produced on a target sheet is undesirably faint due to exhaustion of ink of the absorber 35, it is necessary to newly supply ink to the absorber 35 or change the existing absorber 35 with a new one.

As described above, the present invention provides a ball brayer, which is provided with a spherical ball as its brayer ball. The spherical ball is fabricated with a patterned ball cover, having an external pattern consisting of letters, figures and/or characters and formed on a spherical core body. The spherical ball of this brayer thus smoothly rolls on a target sheet in any desired direction without being limited in its rolling direction during a stamping process while preventing a stamped pattern from being distorted, deformed, or undesirably, partially faint or broken, different from a conventional brayer having a cylindrical brayer roller. The spherical ball of this brayer is also easily and smoothly rotated, and rolls along a short distance to effectively smear ink on its pattern or stamp a clear inked pattern on a target sheet. Therefore, the ball brayer of this invention accomplishes a desired stamping effect.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A ball brayer, comprising:

a roller holder unit having a front head and a handle;

a dome-shaped first upper cap unit seated in the front head of said roller holder unit;

a dome-shaped second upper cap unit provided with a cylindrical top rod, said second upper cap unit being seated in the first upper cap unit by the top rod inserted into an inner fitting cylinder of said first upper cap unit;

a brayer ball rotatably seated in the second upper cap unit and consisting of a spherical core body, and a ball cover formed on the spherical core body and having a pattern on its external surface; and a lower support cap unit detachably mounted to the second upper cap unit, and having an opening for allowing the brayer ball to be partially exposed outside the second upper cap unit.

2. The ball brayer according to claim 1, wherein said front head of the roller holder unit is integrated with said handle, with a holding depression vertically formed on the front head, and a seat opening formed at a mouth of said holding depression to communicate with the holding depression, said seat opening having a curved inner surface of a predetermined radius of curvature and being coaxial with the holding depression.

3. The ball brayer according to claim 1, wherein said first upper cap unit has a hollow cylindrical top cap at its top end, with an inner fitting cylinder formed in the interior of said top cap, and a first hollow dome body integrally extending downward from a lower edge of said top cap to form the dome shape of said first upper cap unit, said first dome body defining a first seat space in its interior and being opened at its lower end.

4. The ball brayer according to claim 1, wherein said second upper cap unit has a cylindrical top rod at its top end, said top rod being inserted into the inner fitting cylinder of the first upper cap unit, with a second hollow dome body integrally extending downward from a lower edge of the top rod to form the dome shape of the second upper cap unit and defining a second seat space in its interior, a plurality of bearing holes formed on a sidewall of said second dome body and seating a plurality of ball bearings, said second upper cap unit also having a step formed along a lower edge of said second dome body.

5. The ball brayer according to claim 4, wherein a diameter of each of said bearing holes is reduced in a direction from an external surface to an internal surface of the sidewall of said second dome body of the second upper cap unit.

6. The ball brayer according to claim 4, wherein said brayer ball is pressed upward into the second seat space defined in the interior of the second dome body when the ball comes into contact with a target sheet, said brayer ball being thus brought into contact with the ball bearings and being seated in the second seat space while leaving a gap between an external surface of the brayer ball and an internal surface of the second dome body.

7. The ball brayer according to claim 1, wherein said cylindrical top rod of the second upper cap unit is provided with a seat hole, with an ink absorber laden with a sufficient amount of ink and being seated in the seat hole such that a lower surface of said ink absorber comes into contact with the external surface of said brayer ball.

8. The ball brayer according to claim 1, wherein said core body of the brayer ball consists of at least two hemispherical parts detachably assembled into a single spherical body by means of two locking members designed to engage with each other.

* * * * *